United States Patent [19]

Sellitto et al.

[11] Patent Number: 4,913,748

[45] Date of Patent: Apr. 3, 1990

[54] METHOD AND APPARATUS FOR CONTINUOUS ANNEALING

[76] Inventors: Thomas A. Sellitto, 12800 Auburn Rd., Chardon, Ohio 44024; Willis E. Perry, 10545 Ridgewater Dr., Painesville, Ohio 44077

[21] Appl. No.: 382,010

[22] Filed: Jul. 17, 1989

Related U.S. Application Data

[63] Continuation of Ser. No. 214,960, Jul. 5, 1988, abandoned.

[51] Int. Cl.[4] ..... C21D 9/56

[52] U.S. Cl. ..... 148/128; 266/103; 266/99

[58] Field of Search ..... 266/45, 85, 102, 103, 266/109, 110, 92, 99, 26; 148/128, 127

[56] References Cited

U.S. PATENT DOCUMENTS

| | | | |
|---|---|---|---|
| 2,009,856 | 7/1936 | Otis et al. | 266/102 |
| 2,060,634 | 11/1936 | Otis | 266/110 |
| 2,109,204 | 2/1938 | Wilson | 266/110 |
| 2,231,852 | 2/1941 | Badlam | 266/103 |
| 2,278,136 | 3/1942 | Otis et al. | 266/92 |
| 2,345,181 | 3/1944 | Cooper et al. | 266/103 |
| 2,409,770 | 10/1946 | Lorig et al. | 266/109 |
| 2,448,835 | 9/1948 | Schefe | 266/103 |
| 2,499,191 | 2/1950 | Jones et al. | 266/109 |
| 2,521,044 | 9/1950 | Cooper et al. | 266/111 |
| 2,730,348 | 1/1956 | Rendel | 266/103 |
| 2,800,327 | 7/1957 | Bandy | 266/103 |
| 3,152,794 | 10/1964 | Alexeff et al. | 266/45 |
| 4,395,021 | 7/1983 | Terakade et al. | 266/85 |

FOREIGN PATENT DOCUMENTS

| | | |
|---|---|---|
| 670248 | 1/1939 | Fed. Rep. of Germany . |
| 135808 | 7/1978 | Japan . |

*Primary Examiner*—S. Kastler

*Attorney, Agent, or Firm*—Watts, Hoffmann, Fisher & Heinke Co.

[57] ABSTRACT

Apparatus for the continuous annealing of strip steel or the like, wherein the apparatus comprises a furnace having an annealing chamber and input and output strip feed structures located on opposite sides of the chamber near the top thereof. The rate at which the strip is feed through the feed structures is regulated by a feed controller which establishes a catenary loop of strip between the feed structures. The strip feed structure includes a mechanism for connecting the trailing end of a section of strip to the leading end of a succeeding strip, whereby a continuous supply of strip is provided to the furnace from a supply of coils of strip or the like. The feed controller is operatively coupled to the input and output strip feed structures for controlling the respective rates of the feed structures, and thereby controlling the size of the loop such that the furnace may be operated concurrently to anneal the strip and function as an accumulator.

16 Claims, 2 Drawing Sheets

METHOD AND APPARATUS FOR CONTINUOUS ANNEALING

This is a continuation of co-pending application Ser. No. 214,960, filed on July 5, 1988, abandoned.

DESCRIPTION

1. Technical Field

This invention relates to an apparatus for continuous annealing of metal strips and a method therefor, and more specifically to a method and apparatus for continuous annealing of metal strips including a vertical accumulator furnace.

2. Background Art

Continuous annealing of strip metal has been practiced in the steel industry for many years. The process normally involves the feeding of a continuous metal strip to an annealing oven. Feeding of the strip must be continuous, since any overheating of the strip held in the oven results in the formation of undesirable grain structure. Once overheated the strip is lost due to its poor grain structure and the corresponding reduction in quality which is experienced with such structure.

Use of accumulators in the annealing line ensures that continuous flow of the strip is provided to an annealing oven during the joining of additional strips to the continuous strip, and continuous flow from the oven when a take-up coil has been completed and the strip is severed to permit another coil to be formed.

A problem with prior continuous strip annealing practices is that significant additional equipment must be added to the annealing line in the form of accumulators. The purchase of such additional equipment requires significant initial capital investment, requires continued support due to normal operating problems and maintenance requirements, and occupies additional plant floor space.

When vertical annealing furnaces are used in annealing practices, continuous operation of the internal heat elements or burners is generally required, and results in high energy use per strip annealed. Combustion exhaust gases exiting the furnace during operation are also wasted. Such annealing practices provide few techniques for achieving a uniform continuous anneal without a corresponding loss of furnace heat efficiency.

Other efforts have been made to provide a vertical continuous annealing furnace overcoming certain of these problems. One such effort is the proposal of U.S. Pat. No. 4,395,021, wherein a vertical annealing furnace for receiving a catenary metal strip, includes two furnace covers forming associated pre-heat and heating chambers. Another effort is the proposal of U.S. Pat. No. 3,152,794, wherein two catenary loops of metal strip are shown as being variable in length. With respect to one another, i.e., as one is shortened the other is extended. By rotation of input and output pinch rolls feeding the strip to and from the loops, respectively, the loops are shortened or lengthened as needed to obtain the proper strip anneal.

DISCLOSURE OF THE INVENTION

The present invention provides a new and improved apparatus for continuous annealing of a metal strip using a vertical furnace as an accumulator which eliminates the need for additional expensive accumulators and their associated equipment, and provides a high quality uniform anneal using energy efficient operating principles.

The annealing apparatus comprises a strip joining station for connecting the trailing end of a section of leaf strip from a lead coil to the leading end of a successive strip from a coil to form a continuous strip, input and output strip feed structures or rollers, a vertical furnace defining an annealing chamber, a controller regulating the rate of strip fed through the feed structures to establish a catenary loop of strip between the structures and within the furnace, and sensors communicating with the controller to process and regulate the respective rates of the feed structures for controlling the size of the loop so that the furnace is concurrently operated to anneal the strip and to function as an accumulator.

In accordance with a preferred construction of the invention the apparatus includes a strip coil supply including structure to support a lead coil and a successive coil of strip metal. Strip is fed from the coil supply to the strip joining station. The strip joining station includes a shear mechanism for trimming the free leading and trailing ends of respective strips to be connected, and a welder for welding the ends together to form the continuous strip.

In a preferred form of the invention a pre-heat station is provided including a heating chamber having a strip inlet and outlet, a gas inlet for receiving exhaust gas from the annealing furnace to heat the chamber, and a gas outlet for releasing exhaust gases from the heating chamber to a recuperator or other heat reclaiming or exchanging device. The recuperator assists in heating furnace combustion gas prior to return to the annealing furnace, and thus provides increased furnace efficiency and decreased energy expense.

The input and output strip feed structures or rollers are positioned on opposite sides of and near the top of the furnace annealing chamber. The input structures are also positioned adjacent the heating chamber strip outlet, such that the input feed structures receive and steer the strip to the annealing furnace upon exit from the heating chamber.

The strip is preferably fed through the feed structures and furnace between the structures in the form of a variable length catenary loop. The furnace includes a strip inlet and outlet on a top portion of the furnace, an exhaust gas outlet releasing exhaust gas from the furnace to the heating chamber, sensors for sensing strip condition, and heat elements or burners activated by the controller for heating the chamber in response to sensor communications.

In a preferred embodiment, the controller regulates the rotation rates of the strip feed structures according to sensed strip condition communications received from the sensors. The sensor communications received by the controller are processed and compared with a controller ideal anneal condition. The controller then regulates the respective rates of the feed structures, and operates the heat elements to conform the sensed strip condition to that of the controller ideal anneal condition.

When the input feed structures are stopped for interconnecting the next successive strip with the continuous strip, the output feed structures continue movement of the strip and thereby deplete the loop within the furnace. The size of the loop is thus controlled so that the furnace concurrently operates to anneal the strip and to function as an accumulator. Since the strip tension in the furnace is also reduced from that of prior catenary furnaces, the likelihood of strip breakage at annealing temperatures is greatly reduced with apparatus constructed in accordance with the preferred embodiment.

The depleted loop is replenished once the continuous strip connection is completed by movement of the strip input feed structures to an overspeed condition. The loop is also replenished when the output feed structure is stopped to accommodate strip severance. The controller and sensors are thus in constant communication regarding strip condition in order to regulate and conform the rate of input and output feed structure rotation and burner operation with the ideal anneal condition.

In a preferred construction, the output feed structure comprises water cooled rollers for quenching the strip upon exiting from the furnace outlet. A post-annealing station receives the strip from the output structures and includes a sensor, structure for further air quenching of the strip, and cleaning and drying structure for treating the strip.

A strip severance station is also provided where the continuously fed strip is separated to form discrete annealed strips. A take-up or recoiling station including structure for coiling the separated annealed strip after it exits the furnace structure is also provided.

In the preferred embodiment of the apparatus the sensed strip condition is communicated to the controller from sensors including width sensors, weight sensors, length sensors, temperature sensors and speed sensors.

In another preferred apparatus, coils are transferred to the strip coil supply from a conventional rolling system and coiler via a heated conveyor so that a high coil temperature is maintained. By maintaining the high coil temperature added energy savings are also obtained.

Other features and advantages of the invention will become apparent from the following detailed description of a preferred embodiment made with reference to the accompanying drawings which form part of the specification.

BEST MODE FOR CARRYING OUT THE INVENTION

Figure 1:
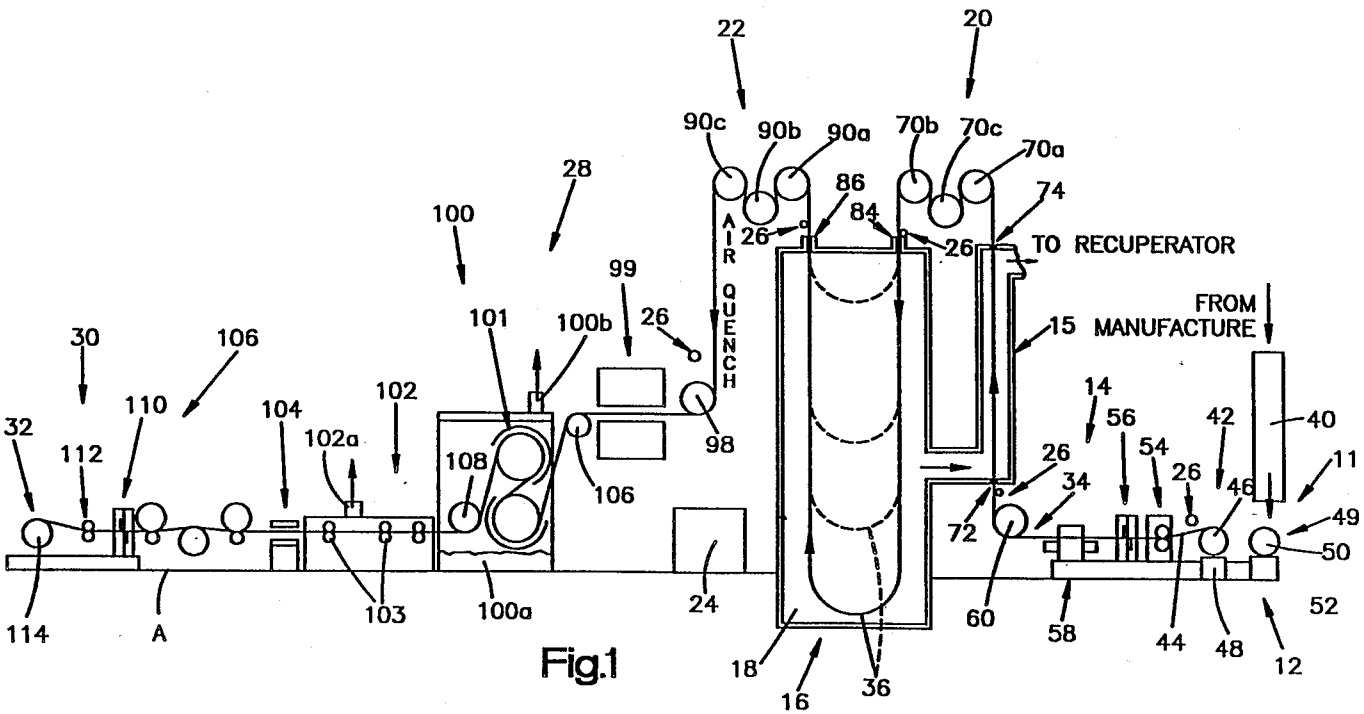
FIG. 1 is a schematic view of an apparatus for continuous annealing of a metal strip using a vertical accumulator furnace constructed according to the present invention.

An apparatus for continuous annealing of strip metal constructed in accordance with the present invention is illustrated generally at reference character 10 in FIG. 1 of the drawings. The apparatus is shown on the plant floor, indicated at reference A, as comprising a pre-entry station 11, a strip supply 12, a strip joining station 14, a pre-heat station 15, a vertical furnace structure 16 defining an annealing chamber 18, input 20 and output 22 strip feeders, an apparatus controller 24, sensors 26, a post-annealing station 28, a strip severance station 30 where the strip is separated to form discrete annealed coils, and take-up structure 32 for coiling an annealed strip .

The pre-entry station 11 referenced in FIG. 1, receives coiled strips of metal directly from the rolling and coiling systems manufacturing the coiled strips, and comprises an enclosed and heated conveyor 40 for maintaining the strips at a temperature still elevated from roll and coil formation. From the pre-entry station, the coils are transferred to the strip supply 12.

The strip supply includes an uncoiling mechanism 42 for receiving, supporting and uncoiling a lead strip 44 from a lead coil 46 on a first support 48. A coil loading mechanism 49 is also included for transferring a successive coil 50 mounted on a second support 52 to the uncoiling mechanism. Once uncoiled, the strip is passed through a conventional bending and peeling mechanism 54 to the strip joining station.

The strip joining station 14 comprises a shear mechanism 56 for trimming free ends of the lead strip 44 and a strip from successive coil 50. Once trimmed, the strips move to a welder 58 which welds the free ends together to form a continuous strip 34 to be annealed. The continuous strip is next moved to the pre-heat station past a steering roller 60.

Figure 2:
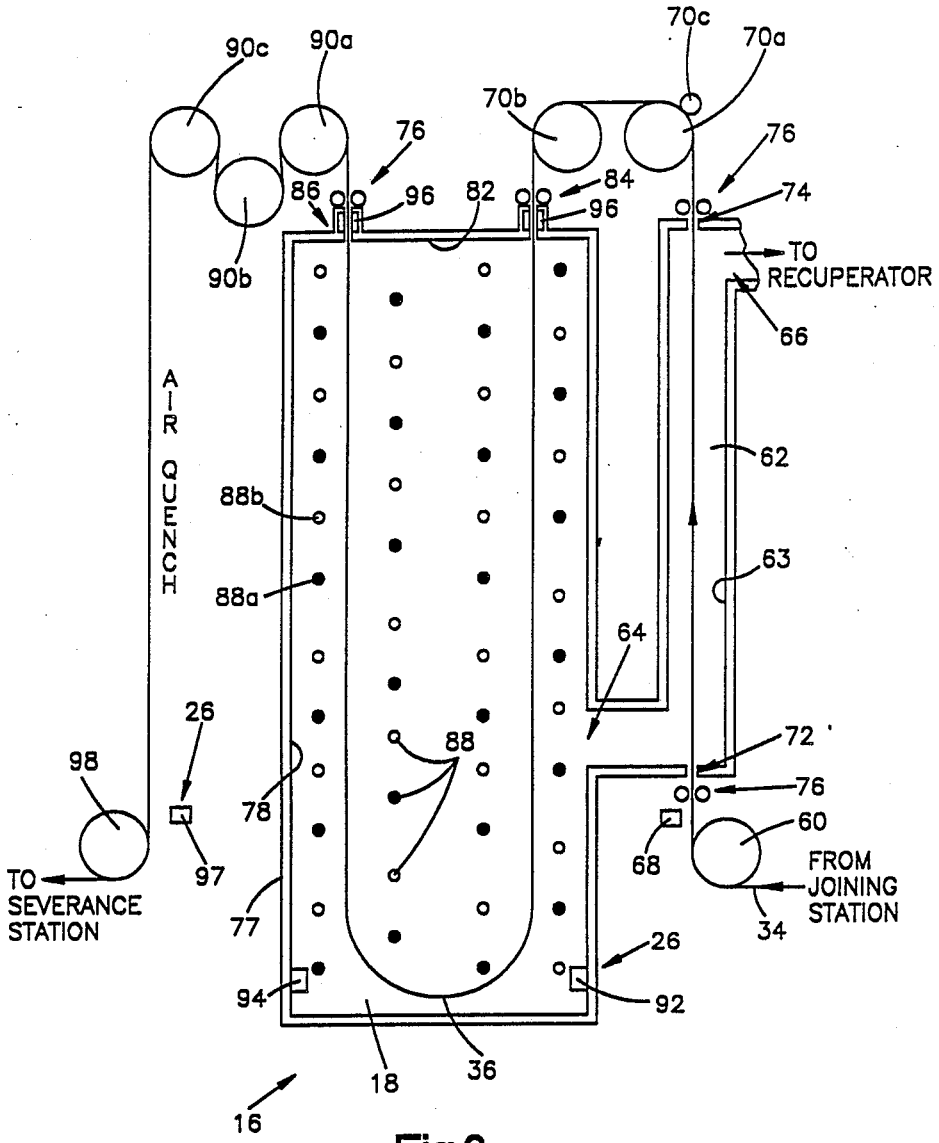
FIG. 2 is a vertical cross-sectional schematic view of the accumulator furnace of FIG. 1.

As shown in FIG. 2, the pre-heat or pre-processing station 15 comprises a heat chamber 62 which is a non-fired chamber with a gas inlet 64 for receiving exhaust gas from the furnace 16 for heating the heat chamber 62, a gas outlet 66 for releasing said exhaust gas from the heat chamber to a recuperator (not illustrated), a sensor 68, and furnace input feed structure 20. As shown in FIG. 2, the input feed structure 20 comprises rollers **70*a* and 70*b* for feeding the strip to the furnace at a controlled rate established by a drive roller 70*c***.

The strip enters the heat chamber 62 past an inlet opening 72 and exits the chamber through an outlet 74. A barrier mechanism 76 is provided at the inlet and outlet to contain the heat chamber and prevent the flow of contaminants into the chamber 62. The recuperator, which comprises a conventional heat exchanger or other heat transfer device, receives the exhaust gas exiting the chamber and uses it to assist in heating combustion gas entering the vertical furnace 16. The heat chamber is lined on an interior surface 63 with firebrick which stores heat energy and re-radiates the heat to the strip.

The sensor 68 comprises a temperature sensor such as a pyrometer for measuring the temperature of the strip prior to entering the heat chamber and a tachometer for sensing strip speed. The temperature sensed by the sensor is communicated to the interconnected controller 24. The furnace input feed rollers **70*a* and 70*b*** feed the strip to the vertical furnace at a controlled rate also determined by the controller.

The vertical furnace structure 16 is defined by an annealing chamber 18 having an outer shell 77 of steel, interior side walls 78 insulated with fiber insulation having very low heat retention, a bottom portion 80 insulated with firebrick, and a top portion 82 also constructed of steel and lined with low heat retention fiber insulation. The annealing chamber includes a strip inlet 84 and a strip outlet 86 in the top portion 82 of the furnace, and barriers 76 associated with the inlet and outlet of the type set forth with respect to the heat chamber. Exhaust gas from the annealing chamber is released to the interconnected heat chamber 62 via the inlet 64.

Burners or heating elements 88, shown in vertical cross-section in FIG. 2, mounted in the furnace side walls for heating the chamber to the required annealing temperature, are activated by the controller in response to the communication of information from the sensors 26. The dark burners indicate burners mounted on the near side wall 78, and the light burners indicate burners **88*b*** mounted on the far side wall of the furnace.

The input strip feed structures 20 having rollers 70a and 70b, are rotated by a drive roller 70c at a rate controlled by the controller 24. The output feed structures 22 comprises rollers 90a, 90b, and 90c. A catenary loop 36 of the continuous strip 34 is extended between the input and output feed structures 20, 22, to provide accumulation of the strip within the furnace, The size of the loop is controlled by rotation of the respective input and output rollers.

Strip or loop position within the furnace is monitored by sensors 92 comprising photo cells interconnected with the controller for communicating loop position. Strip temperature is sensed by pyrometer sensors 94, 96 positioned at the annealing chamber bottom 80, inlet 84 and outlet 86 so that the strip annealing temperature is monitored within the chamber and as the strip enters and exits the chamber.

The output feed structure rollers 90a, 90b, 90c, comprise water cooled rollers for quenching the annealing strip as it emerges from the furnace to a lower temperature for preserving strip grain structure.

The apparatus controller 24 comprises a programmed computer having an ideal annealing model therein. The computer is operatively interconnected with each of the sensors 26 for receiving sensed strip conditions from the pre-heat station 15, the annealing chamber 18 and the post annealing station 28, as well as the burners 88, and the feed structure. Input conditions, such as strip width, gauge and speed are also provided by sensors 26 located at the pre-heat station for calculating the pounds of coil per hour processed through the annealing chamber. The computer compares these inputs, together with sensed conditions received from the sensors to conditions in the programmed ideal annealing model, and computes the necessary levels of burner operation and strip speed through the apparatus in order to match the ideal model. Once the levels determined, the computer then makes appropriate adjustments to conform the sensed strip conditions with the ideal annealing model conditions.

The post-annealing station 28 includes the output feed structure 22 having water cooled rollers 90a, 90b, 90c, for removing the strip from the chamber and moving it through an air quenching section as indicated in the drawings, a steering roll 98, a pyrometer sensor 97 for sensing strip temperature after quenching, and a series of cleaning mechanisms, including a blast cleaner 99; a pickling bath 100 of sodium sulfate 100a having a bridle 101 therein for containing the strip, and an exhaust exit 100b with gases shown exiting at the arrow; a surface cleaner 102 having an exhaust exit 102a also with gases shown exiting at the arrow, brushes 103 and a dryer 104. Deflector rolls 106 are also included along the series of cleaner mechanisms.

At the strip severance station 30 the strip is separated to form discrete annealed coils by a shear mechanism 110, moved through pinch rolls 112, to the take-up structure 32 where the strip is recoiled in an annealed coil 114 by a recoiler mechanism.

During operation of the annealing apparatus, successive strips are continuously connected with the continuous strip 34 at the joining station 14. During connection of the strips, the controller regulates the input feed structure 20 rotation so that strip input to the furnace is stopped. During the stoppage the output feed structure continues to remove strip from the furnace, depleting the loop within the chamber through the phantom conditions shown in FIG. 2. When a reduction in the length of the loop is detected by the sensors 92, the controller may turn off the lower burners to further conserve energy. If strip length is reduced beyond a minimum condition, the controller shuts the burners down for up to a two minute period.

Once the strip is connected, the controller reactivates the burners and moves the input feed structure to an overspeed condition for rapidly feeding an amount of strip, calculated by the controller together with the tachometer and photo cell sensors, into the chamber until the depleted loop 36 is replenished. The furnace thus operates to concurrently operate as an annealing chamber and as an accumulator.

In order to achieve uniform strip anneal and increased furnace efficiency, the apparatus controller 24 and sensors 26 are thus constantly communicating regarding strip speed, temperature and position in order to continuously communicate, regulate and conform the rate of input and output feed structure rotation, strip temperature and burner operation to the ideal anneal condition.

While a preferred embodiment of the invention has been disclosed in detail, the present invention is not to be considered limited to the precise constructions disclosed here. Various adaptations, modifications and uses of the invention may occur to those skilled in the art to which the invention relates and the intention is to cover all such adaptations, modifications and uses falling within the spirit or scope of the appended claims.

We claim:

1. A method for continuous annealing in a vertical annealing furnace comprising:

(a) regulating movement and condition of a lead metal strip through said furnace using a controller;

(b) receiving a successive metal strip to be annealed at an entry station;

(c) connecting a trailing end of said lead strip with a leaf end of a successive metal strip to form a continuous metal strip to be annealed;

(d) sensing strip conditions at said entry station using sensors and communicating said sensed strip conditions to the controller;

(e) supplying strip to the annealing furnace by an input feed mechanism operating at a rate established by said controller, said furnace receiving said strip and having heat elements activated and controlled by said controller to achieve a desired condition for annealing, (f) sensing strip conditions in said furnace including strip temperature by using sensors and communicating said sensed strip conditions to the controller;

(g) accumulating said strip within said furnace in the form of a variable catenary loop;

(h) depleting said catenary loop while continuing to remove strip from said furnace by an output feed mechanism operating at a rate established by the controller according to said condition sensed in the furnace while concurrently operating said joiner forming said continuous metal strip; and (i) periodically severing an annealed strip sections from said continuous metal strip an exit station.

2. A process for the continuous annealing of metal strip:

(a) establishing a catenary loop of moving strip in a vertical annealing furnace;

(b) successively supplying coils of strip metal to an entry station;

(c) successively joining the lead end of a delivered coil to the trailing end of the last preceding coil and concurrently shortening the catenary loop;
(d) coiling annealed strip at an exit station;
(e) severing the strip at the exit station when a coil of annealed strip has been formed and starting the formation of a succeeding coil of annealed strip while concurrently lengthening the catenary loop;
(f) controlling the annealing of the strip by sensing temperature conditions of the strip, feeding signals representative of sensed temperature conditions to a controller and operating the controller in response to such signals to control the size of the loop, and the rate of strip travel through the furnace such that the loop in the furnace is concurrently both an accumulator loop and that portion of the strip being annealed; and
(g) operating the controller in response to such signals to control the operation of heaters in the furnace.

3. A strip annealing system comprising:
(a) a vertical annealing furnace including a chamber and entry and exit feed rollers, the chamber being adapted to contain a strip of metal in a catenary loop of varying length;
(b) an entry station including a coil support, and a welder respectively for supplying strip metal and welding strip end portions together;
(c) the entry station including means establishing a substantially direct strip feed path from the coil support to the entry roller;
(d) an exit station including a coiler and a shear respectively adapted to coil annealed strip and to shear such strip to delineate coil ends;
(e) the system including sensors for sensing strip temperature;
(f) a controller connected to the sensors to receive signals from the sensors, the controller including furnace feed and heater control means for controlling the relative speeds of the entry and exit rollers and thereby control the size of such catenary loop such that the loop is concurrently both an accumulator loop and the strip portion being annealed in the furnace and to control the temperature of the furnace whereby to achieve desired annealing temperatures in the strip.

4. The system of claim 3 wherein the feed control means is adapted to arrest strip input into the furnace while maintaining strip output thereby reducing the size of such catenary loop as the welder is operated to connect strip end portions together.

5. The system of claim 3 wherein the feed control means is adapted to arrest strip output from the furnace while maintaining strip input thereby increasing the size of such catenary loop as the exit station shear is operated.

6. Apparatus for the continuous annealing of metal strips, comprising:
(a) a furnace defining an annealing chamber;
(b) the furnace including input and output strip feed structures positioned on opposite sides of, and near the top of, said chamber;
(c) said strip feed structures respectively including means for controlling the rates of strip feed to establish a catenary loop of strip therebetween;
(d) the strip feed structures including a mechanism to connect the trailing end of a section of strip to the leading end of a succeeding strip whereby a continuous strip supply is fed to the furnace from a supply of coils of strip or the like;
(e) a feed control means operatively coupled to the strip feed structures for controlling the respective rates of the feed structures in response to signals from a sensing means which emits such signals in response to sensed conditions including the temperature of the strip to assure it reaches annealing temperature and thereby controlling the size of the loop; and
(f) furnace control means responsive to strip temperature induced signals to control the temperature of the furnace such that the furnace when in use is concurrently operated to anneal such strip and to vary the size of the loop to function as an accumulator.

7. An annealing furnace comprising:
(a) a strip supply including a structure to support a lead coil and at least one successive coil of strip metal and a strip joining station for joining the trailing end of the lead coil and the leading end of a successive coil together, whereby strip from said coils may be fed endlessly;
(b) furnace structure defining an annealing chamber and input and output strip feeders;
(c) a take-up including structure for coiling annealed strip after it exits the furnace structure and a strip severance station for severing an endlessly fed strip to permit the formation of discrete annealed coils;
(d) a controller connected to the feeders and constructed to control strip feeders to, from said through the chamber to permit the establishment and size control of a free loop of strip in the furnace; and
(e) the controller including feed control means to stop the feed of strip into the furnace by the input feeder as a welding operation is performed while continuing output feed from the furnace and to stop the output feed from the furnace as a severance operation is performed while permitting input feed if conditions warrant whereby the free loop in the furnace functions as an accumulator to permit continuous operation, the feed control means also including a sensor to measure strip temperature and a furnace temperature control means operatively connected to the sensor to vary the temperature of the furnace to assure that the strip is heated to its annealing temperature.

8. An apparatus for continuous annealing of a steel strip comprising:
(a) a controller for regulating movement of the strip through said apparatus and controlling furnace temperature;
(b) an entry station for receiving first and second strips and having a joiner for connecting a free end of the first strip with a free end of the second strip to form a continuous strip to be annealed;
(c) a pre-processing station comprising a heat chamber, sensors for sensing strip width, speed and temperature, and feed rollers for feeding said strip at a controller speed;
(d) a processing station comprising a vertical furnace for receiving said continuous strip from said feed rollers and forming a cantenary loop within said furnace, and having sensors communicating with the controller for sensing strip length and temperature within the furnace, and burners activated by said controller;

(e) a post-processing station including processing means including feed rollers for continuing removable of said strip from the furnace at a controlled speed despite stoppage of the feed rollers supplying strip due to operation of the joiner, means for cooling and cleaning the strip, and sensor means connected to the controller, the sensor means being for sensing strip temperature, the processing means being connected to the controller and thereby operated in response to sensed temperature conditions to control strip feed and furnace temperature thereby to assure the strip is heated to its annealing temperature before it is removed from the furnace; and (f) an exit station for severing an annealed strip from said continuous strip.

9. An apparatus as set forth in claim 3 wherein the controller includes a processor means for receiving sensed conditions from said pre-processing, processing and post-processing station sensors, comparing said sensed conditions to conditions in an ideal annealing model, and comparing station adjustments needed to achieve conditions conforming to the annealing model, and implementing said station adjustments to conform the sensed strip conditions with the ideal annealing model conditions.

10. An apparatus as set forth in claim 8 wherein said entry station joiner comprises a shear mechanism for trimming free ends of said first and second strips and a welder for welding said free ends together to form a continuous strip to be annealed.

11. An apparatus as set forth in claim 8 wherein said pre-processing station heat chamber includes a gas inlet receiving exhaust gas from said furnace for heating said heat chamber, and a gas outlet for releasing said exhaust gas from said heat chamber to a recuperator, wherein said recuperator assists in heating combustion gas prior to entering the furnace.

12. The apparatus of claim 8 wherein said vertical furnace includes a strip inlet and a strip outlet on a top portion of the furnace, an exhaust gas outlet releasing exhaust gas from the furnace to an interconnected heat chamber, and wherein said burners heating said strip are activated by said controller in response to sensor communications.

13. An apparatus as set forth in claim 3 wherein said controller determines the rate of rotation of said feed rollers moving the strip, and provides an overspeed condition for rapidly feeding the strip to the furnace inlet at a rate established by sensor communications to the controller.

14. An apparatus as in claim 3 wherein said strip length sensors comprise photocells, said strip temperature sensors comprise pyrometers, and said strip speed sensors comprise tachometers.

15. An apparatus as set forth in claim 3 further comprising a pre-entry station for transporting new coils of metal strip to the entry station by a heated conveyor for maintaining the elevated temperature of the coils during transport.

16. An apparatus for continuous annealing of a metal strip comprising:

(a) a controller for regulating movement and condition of such a strip through said apparatus;

(b) an entry station for receiving a metal strip to be annealed including a joiner for connecting a free end of such a strip with a free end of a successive metal strip to form a continuous metal strip to be annealed, and sensors for sensing strip conditions and transmitting signals representative of said sensed conditions to the controller;

(c) a processing station including an input feed mechanism for supplying strip at a rate established by said controller;

(d) a vertical annealing furnace for receiving said strip, heat treating a catenary loop of such strip in the furnace and having heat elements activated by said controller to achieve a desired condition for annealing;

(e) sensors for sensing strip conditions including strip temperature and transferring said sensed conditions to the controller, and an output feed mechanism for removing strip from said furnace at a rate established by the controller according to said sensed conditions and continuing such removal concurrently with operation of said joiner to form such continuous metal strip, said controller including control means for effecting control of the input and output feed mechanisms and thereby varying the size of such loop in the furnace, the speed at which the strip travels and the operation of the heat elements whereby to produce a temperature time relationship in the furnace appropriate to achieve the desired anneal; and (f) an exit station for severing an annealed strip from said continuous metal strip.

* * * * *